US005361565A

United States Patent [19]

Bayer

[11] Patent Number: 5,361,565

[45] Date of Patent: Nov. 8, 1994

[54] ELEVATING SYSTEM

[76] Inventor: Robert F. Bayer, 2 Schooners Cove, E. Setauket, N.Y. 11733

[21] Appl. No.: 2,867

[22] Filed: Jan. 19, 1993

[51] Int. Cl.[5] ..... B66D 1/00

[52] U.S. Cl. ..... 254/292; 254/270; 254/273; 318/49; 318/112

[58] Field of Search ..... 318/45, 112; 254/270, 254/274, 276, 362, 335, 343, 290, 273, 292, 272

[56] References Cited

U.S. PATENT DOCUMENTS

| | | | |
|---|---|---|---|
| 4,236,456 | 12/1980 | Schreyer et al. | 105/154 |
| 4,298,831 | 11/1981 | Espelage et al. | 318/112 |
| 4,361,312 | 11/1982 | Schreyer et al. | 254/276 |
| 4,448,397 | 5/1984 | Broyden | 254/360 |
| 4,520,247 | 5/1985 | Pancook et al. | 200/298 |
| 4,576,363 | 3/1986 | Pancook | 254/372 |
| 4,635,903 | 1/1987 | Broyden et al. | 254/362 |
| 4,636,962 | 1/1987 | Broyden et al. | 364/478 |
| 4,640,389 | 2/1987 | Kamaike | 187/119 |
| 4,749,920 | 6/1987 | Jaeger et al. | 318/112 |
| 4,780,650 | 10/1988 | Miyazaki et al. | 318/112 |
| 4,902,954 | 2/1990 | Oshima et al. | 318/762 |
| 5,070,290 | 12/1991 | Iwasa et al. | 318/758 |
| 5,106,057 | 4/1992 | Feller et al. | 254/292 |

OTHER PUBLICATIONS

Strand Lighting, "Self Climbing Lighting Hoist",-Brochure-Mar. 1992.

Italian TV Studio Literature-Motorized Battens-prior to 1993.

Tomcat, "Staging, Lighting and Support Systems"--Brochure-prior to 1993.

Hoffend & Sons, Inc. "1992 Product Review"-Brochure-1992.

Hoffend & Sons, Inc. "Fly Master 99"-Brochure 1992.

Hoffend & Sons, Inc. "Studio Rigging-The Advanced Self-Climber & Studio Hoist"-Brochure-1992.

*Primary Examiner*—Katherine Matecki

*Attorney, Agent, or Firm*—Roylance, Abrams, Berdo & Goodman

[57] ABSTRACT

An elevating system especially designed for raising and lowering battens used in stages. The elevating system preferably uses two or more winch assemblies with synchronous motors coupled together in parallel to an AC inverter to provide smooth, ramped starting and stopping of the winch assemblies as well as torque boost, speed boost, and electric braking. Each winch assembly is provided with numerous safety features such as overload and underload protection, automatic releveling of the batten, thermal overload protection and cable drum lock protection.

47 Claims, 8 Drawing Sheets

ELEVATING SYSTEM

FIELD OF THE INVENTION

This invention relates to an elevating system for safely raising and lowering equipment such as lighting equipment, scenery and drapery. More specifically, this invention relates to a motorized winch assembly provided with numerous safety features such as overload-/underload protection, automatic releveling, thermal overload protection and cable drum lock protection.

BACKGROUND OF THE INVENTION

On theater stages and TV studios, horizontal pipe battens or trusses are utilized to suspend lighting, scenery, drapery and other equipment. These battens usually consist of pipes joined together with sleeves to form the desired length batten. Typically, these battens can be 50 ft. or more in length. To support heavy loads or where suspension points are spaced 15 ft. to 30 ft. apart, battens are fabricated in either ladder, triangular or box truss forms. Aluminum pipe or tubing is utilized to reduce the weight of the batten, when weight is an important factor.

Battens often need to be easily lowered for changing and servicing the suspended equipment. Currently, numerous elevating or hoisting systems are available for supporting, raising and lowering battens. One of the most common and least expensive batten elevating systems is a counterweighted carriage which includes a moveable counterweight for counterbalancing the batten and equipment supported thereon.

Another common elevating or hoisting system uses a winch to raise and lower the battens. Usually hand or electric operated winches are used to raise or lower the batten. Occasionally, in other more expensive installations, a hydraulic or pneumatic motorized winch or cylinder device is used to raise and lower the batten. The batten in a winch type elevating system is typically connected to the winch via a plurality of cables. Specifically, the cables are attached at one end to the batten and then run over pulleys located at the stage ceiling and then directed downwardly through multi-groove pulleys on the side walls, and finally connected at their other ends to the winch.

Except in the case of chain winches, usually a single winch operates each of the battens. Battens rigged with chain winches, on the other hand, usually require multiple winches since it is not practical to run multiple heavy chains across the ceiling. Chain winches are either suspended from the ceiling or mounted directly to the batten. Hand winches are almost always mounted on the wall, while electric winches, with one or more cable drums, can be mounted almost anywhere. Counterweight systems and hydraulic or pneumatic winch systems are all typically located at the side walls.

Many elevating systems have one or two locking devices and at least one form of overload limiting device. One example of an overload limiting device is a counterweight carriage system which includes a carriage holding a weight which is attached to the pipe batten by multiple cables. These cables run from the top of the counterweight to the batten over multiple sheaves and a head block. The size or height of the carriage limits the amount of counterbalancing load, and therefore acts as the weight overload limit. In a counterweight system, the locking device would consist of a hand operating rope that is attached at one end to the top of the counterweight and then run over a head block, down to the stage, through a hand rope lock for locking the counterweight in place, and then around a floor block and back up to the bottom of the counterweight. The hand rope lock locks the rope when either batten or counterweight loads are being changed and rebalanced, and locks the loads when not moving.

In a sandbag counterweight system, the locking device is merely a rope tied off to a stage mounted pin rail, while the overload limit is regulated by the size of the sandbag. In this rigging design, however, any number of additional bags can be added to the set of rope lines, and thereby exceed the safe limit of the suspension ropes and defeat the overload limiting feature.

Hand operated winches typically have worm gear drives with about a 50 to 1 gear ratio, and they use friction as their locking device. The strength of the person turning the operating handle of the winch acts as the overload limiting system. A second safety lock for a worm gear winch is provided by tying off its operating handle. However, these winches will occasionally free run when heavily loaded and will then dangerously drop their suspended load. Other types of hand winches use a ratchet lock, but again these winches are also susceptible to free running when they are heavily loaded and hand operated. In all hand operated winch designs, multiple cables from the batten terminate to a clew plate which is then attached to a single cable wrapped around the winch drum. Thus, the load is in effect suspended by a single cable and single winch, either of which when they fail will completely drop the load.

Motorized winches can be mounted either on a wall, a batten (self-climbing) or a grid (ceiling beam). Typically, motorized winches use abruptly stopping electric friction brakes and worm gear reducers for their load locking device, and (at the least) their horsepower rating to act as their overload limit. Some more advanced designs incorporate limit switches that sense pulley motion over which the supporting cables have been run to detect weight overloads and underloads. Expensive winch designs, with electronic drives, monitor the back EMF for excessive torque to detect overloads. Motorized winch systems also utilize end of travel limit switches to prevent excessive travel in either direction and thermal overloads to detect motor overheating. Most motorized winch designs do not include any form of smooth ramped starting and stopping to prevent damage to the lamp filaments when raising and lowering lighting battens as it is very expensive.

In professional theater installations, computer controlled drives use variable speed drives to control stepper, AC & DC motors, with and without some form of position feedback. These systems are usually too complex and too expensive for most theater rigging installations.

Only in professional theater scenery operation, where the rapid operation of set pieces is necessary for a production, is the expense of multiple drive motors with multiple variable speed drive controls incorporated. These systems often utilize computer controls, servo feedback systems or some form of shaft encoder to monitor and control the loads. For the average theater or studio, maintenance of these expensive professional elevating systems is too complex. Moreover, these complex elevating systems are difficult and dangerous to operate, except by trained technicians or engineers.

One typical motorized winch design is a self-contained, self-climbing design. It uses a single drive motor, two flat cable drums, a single worm gear reducer with a 58:1 ratio, and weight detecting limit switches. The weight detecting limit switches are mounted adjacent to spring loaded pulleys which have the two suspension cables run under them. They detect weight overload and underload on the two cables when they are tilted in and out from varying loads on the cables. The cables wind upon themselves on their respective drums and the load travels perfectly vertically. This type of system is suitable for short 10 ft. battens which are typically used in TV studios. However, they are unsafe since either a single cable, drive, or gearbox failure would cause the entire load to drop down. Most other types of winch systems use more than two suspension cables attached to a single batten for safety.

Another motorized winch design is a common drive shaft ceiling mount type which uses one large ceiling mounted winch drive system connected to a long drive shaft with a plurality of cable drums clamped to the underside of the ceiling I-beams. Each cable drum is located at a cable drop point. This design adds additional cables to support the pipe batten and thus is safer than the single cable support design and the two cable support design. However, load locking in this type of winch relies upon a single common shaft with multiple flexible couplings, driven by a single gearbox and locked by a single gearbox and brake. The winch is usually inaccessibly mounted at the ceiling and the load moves horizontally during raising and lowering. End of travel limit switches, located at the winch, prevent overtravel but there is no underload protection should the batten hit an obstruction. Starting and stopping is abrupt since an electric brake mounted on the drive motor, must be used to support the load.

There is a self-climbing winch design, in which the horizontal travel of the batten during raising and lowering of the batten is eliminated by using a single large motorized winch mounted on wheels and tracking in a square box truss batten. In this design, the winch rotates a common shaft which drives multiple cable drums mounted across the batten. The entire mechanism travels horizontally within the box batten during drum rotation to eliminate misalignment of the suspension cables, and thereby provide a vertical travel of the batten as the cables are wound up. Again, the safety of multiple suspension points is provided. However, only a single gearbox and brake system is utilized for supporting the load. Also starting and stopping are abrupt. This makes this drive less than satisfactory for a lighting batten.

It is common for hand operated winches to run and drop their load or for the winches to pull from their wall mountings causing their loads to crash onto the stage. Electric brake winches used in all forms of rigging systems often fail as well as all forms of rigging systems with only one or two primary suspension lines to a batten. In systems using single drive motors and single end of travel up and end of travel down limit switches, it is not uncommon to have a single switch failure destroy the entire system.

Rope lines in manila rope sets regularly fail due to damaged ropes or overloads. Counterweighted carriage systems are often carelessly operated or improperly counterweighted, and brake free from their rope locks and crash to the stage. In the older cast iron type counterweight carriage systems, they have broken and dropped their loads causing an up-down crash. In other words, first the counterweight crashes to the stage typically because too many lights were removed from the batten without lightening the counterweight. Then, after the counterweight crashes and brakes its bottom weight holding casting, the lighting pipe comes down and it crashes the stage.

Motorized drive systems mounted to the ceiling grid of stages, even when accessible, have failed due to the difficulty in servicing them as they cannot be easily removed or repaired, unless the entire batten load is removed.

In view of the above, it is apparent that there exists a need for an elevating system which will overcome the problems of the prior art, and which is safe to operate and inexpensive to manufacture. This invention addresses this need in the art along with other needs which will become apparent to those skilled in the art once given this disclosure.

SUMMARY OF THE INVENTION

This invention relates to a cost effective, extremely safe operable theater lighting batten rigging system which is easily serviced and eliminates all of the previously listed rigging hazards. It is intended for all theater and TV studio lighting battens in educational, nonprofessional and professional installations and is suitable for slow moving scenery and drapery rigging as well.

Accordingly, a primary object of the present invention is to provide an elevating system which is extremely safe to operate.

Another object of the present invention is to provide an elevating system having at least two winch assemblies, preferably three or more, with each winch assembly having a synchronous motor coupled in parallel to a single AC inverter.

Another object of the present invention is to provide an elevating system which is relatively inexpensive to manufacture and operate.

Another object of the present invention is to provide a winch assembly with an overload and underload protection.

Still another object of the present invention is to provide a winch assembly with a locking assembly to prevent movement of the winch assembly when stopped.

Yet another object of the present invention is to provide an elevating system with a mechanism for releveling each of the winch assemblies upon completely lowering the elevating system.

The foregoing objects are basically attained by providing an elevating system for raising and lowering items, comprising: a support member for supporting an item to be raised and lowered; at least two winches coupled to the support member at spaced locations for raising and lowering the support member with each of the winches including a cable, a rotatably mounted drum for dispensing and retracting the cable therefrom, and a synchronous motor for rotating the drum; and a control unit electrically coupled to each of the motors for operating each of the winches with the control unit including a single inverter electrically coupling each of the motors in parallel for simultaneously starting the motors by varying input frequency to slowly ramp the output of the motors during starting and stopping of the motors.

The foregoing objects are also attained by providing an elevating system for hoisting items, the combination comprising: a first support member for supporting an item to be raised and lowered; at least two winches coupled to the support member at spaced locations for raising and lowering the support member with each of the winches including a cable, a rotatably mounted drum for dispensing and retracting the cable therefrom, and a synchronous motor for rotating the drum; and a control unit electrically coupled to each of the motors for operating each of the winches with the control unit including a releveling mechanism coupled to each of the motors for individually and independently stopping each of the motors after each of the winches reaches a predetermined lowermost position.

The foregoing objects are further attained by providing a winch assembly for hoisting items, the combination comprising: a winch housing adapted to be coupled to a first support member; a drum rotatably coupled to the winch housing, for dispensing and retracting a cable therefrom, the cable having a first end fixedly coupled to the drum and a second end coupled to a mounting member; a motor coupled to the drum for rotating the drum; a first sheave adapted to be rotatably mounted to a second support member spaced from the first support member for operatively engaging the cable; an overload/underload protection mechanism coupled to the second end of the cable for sensing overloads and underloads on the cable to stop the motor, the overload-/underload protection mechanism including a biasing member coupled between the second end of the cable and the mounting member, and a switch electrically coupled to the motor for stopping rotation of the drum upon a predetermined distance of deflection of the biasing member.

Other objects, advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings which form part of this original disclosure.

DETAIL DESCRIPTION OF THE INVENTION

Figure 1:
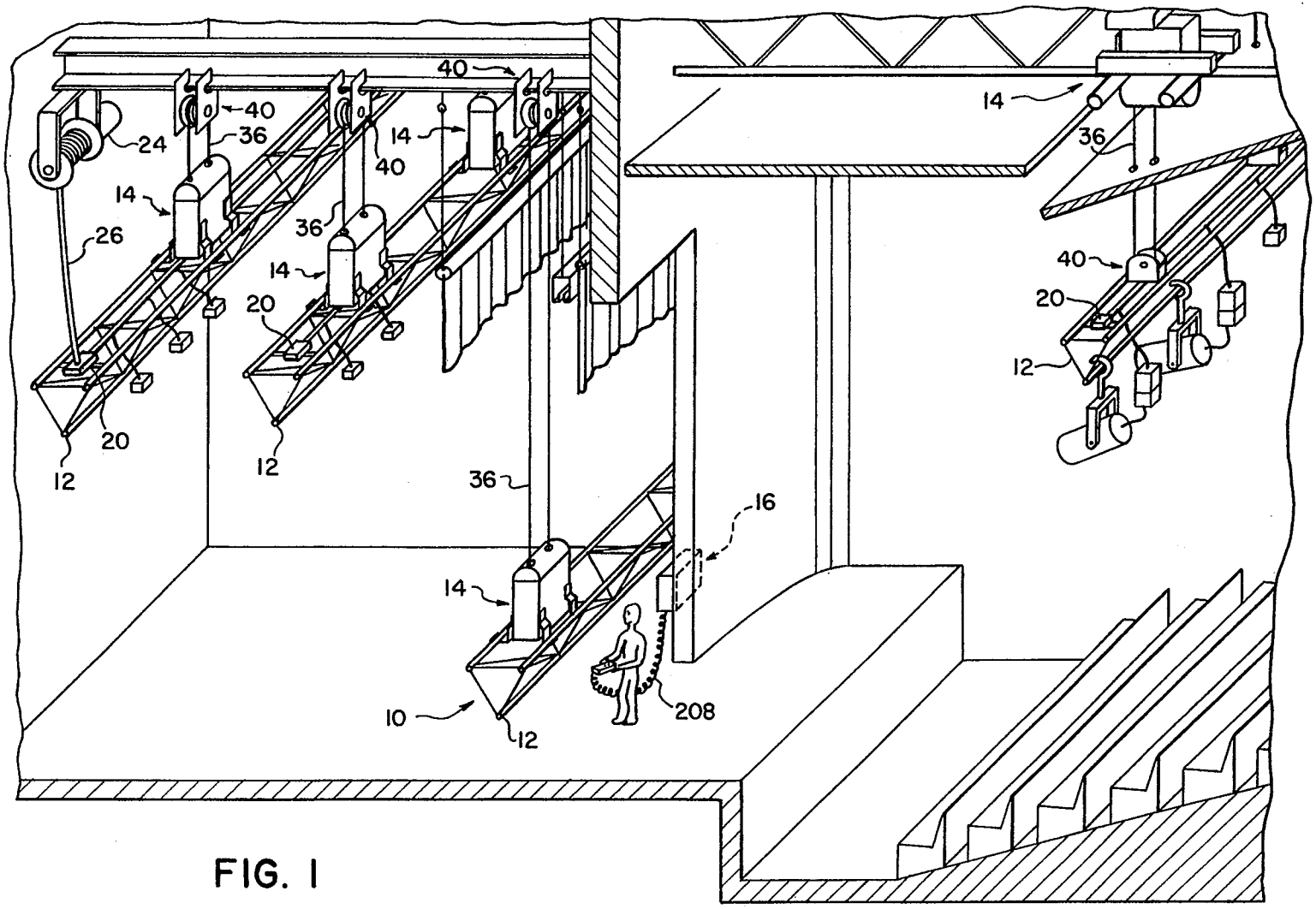
FIG. 1 is a partial, schematic perspective view of an elevating system installed in a theater in accordance with the present invention, and showing winch assemblies in both self-climbing and inverted positions.
Figure 3:
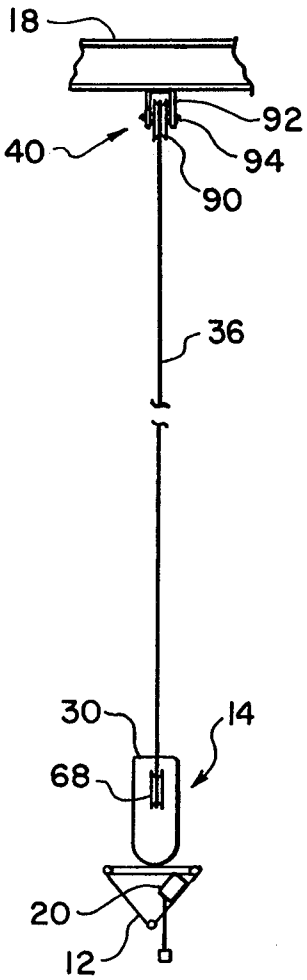
FIG. 3 is a partial, side elevational view of the winch assembly illustrated in FIG. 2.

Referring initially to FIG. 1, an elevating system 10 in accordance with the present invention is schematically illustrated, and includes a plurality of battens or trusses 12, a plurality of winch assemblies 14 coupled to each of the batten 12 for raising and lowering battens 12, a control unit 16 electrically coupled to each of the winch assemblies 14 for controlling the winch assemblies 14 as they raise and lower battens 12.

Figure 2:
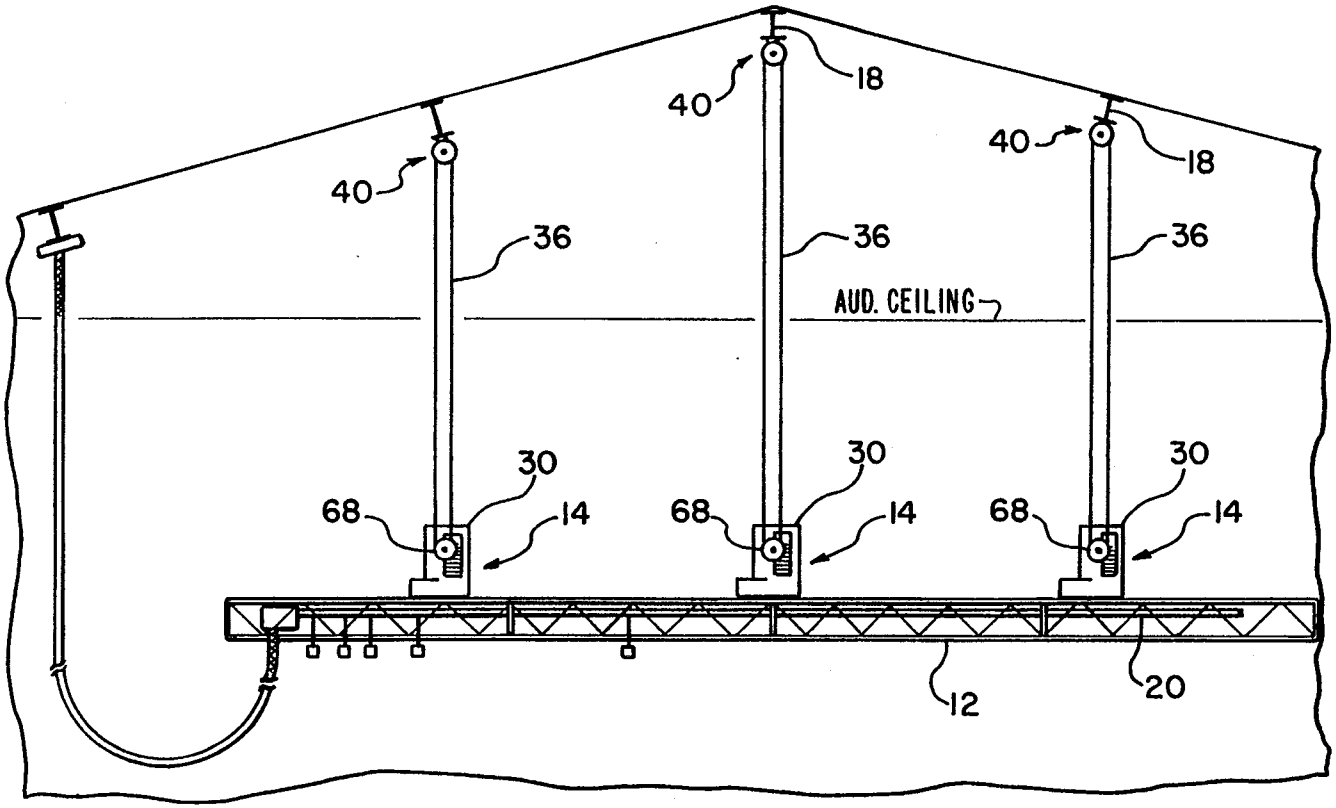
FIG. 2 is a front, partial elevational view of a winch assembly coupled to a support truss or batten in a self-climbing position for movement therewith.
Figure 5:
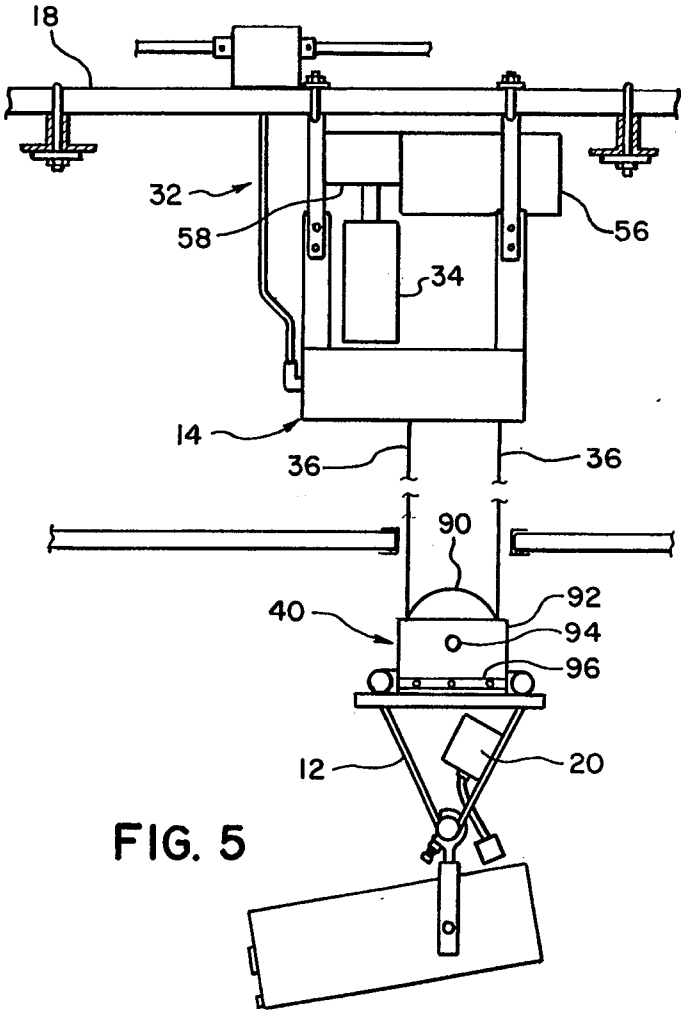
FIG. 5 is a partial, side elevational view of the winch assembly illustrated in FIG. 4.
Figure 4:
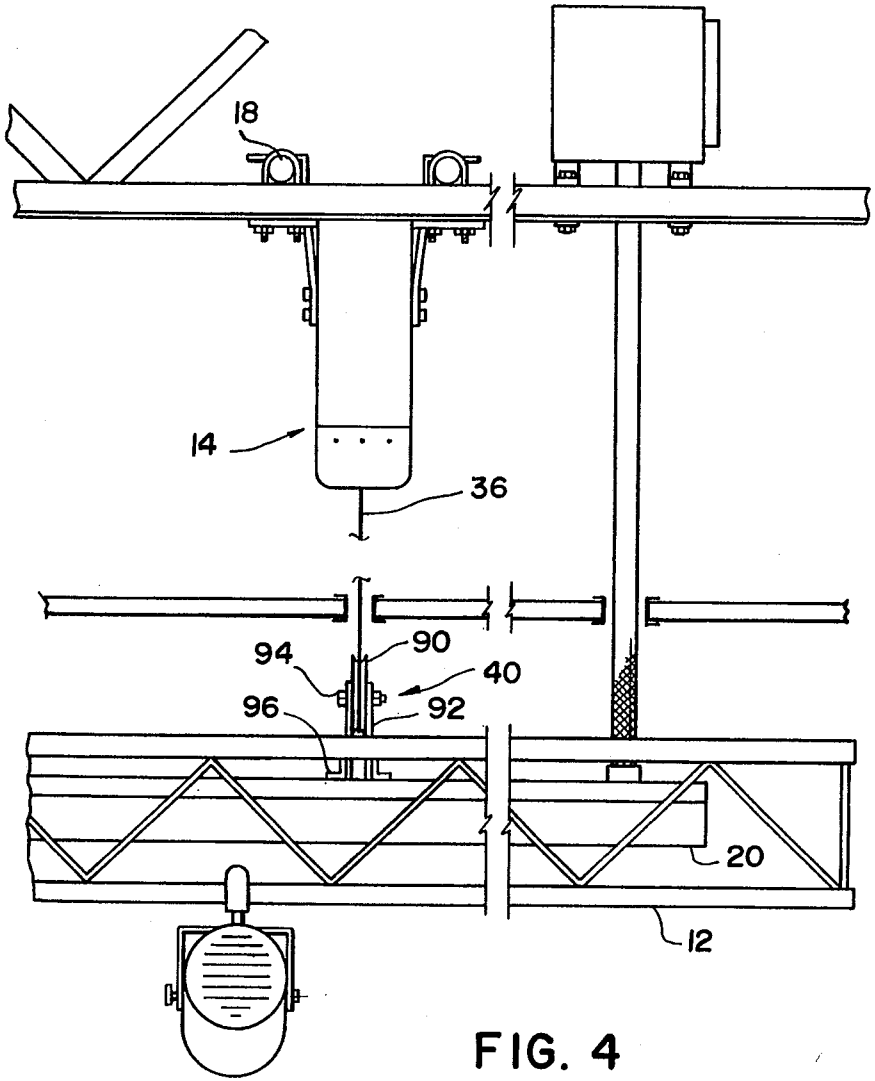
FIG. 4 is a partial, front elevational view of a winch assembly coupled to the ceiling of a theater in an inverted position.

As seen in FIG. 2, preferably, each batten 12 has three or more winch assemblies 14 coupled thereto to provide the safest arrangement. However, it would be possible to use one or two winch assemblies 14 for raising and lowering a batten 12. Although, such an arrangement would not be as safe as using three or more winch assemblies. Each of the battens 12 is independently operated from each other via control unit 16. Truss or battens, such as battens 12 are well known in the art, and thus, battens 12 will not be discussed in detail herein.

Preferably, lightweight aluminum truss type battens 12 are utilized to transfer part of the weight of equipment on the batten to other suspension points along the truss for increasing the lifting ability of any single winch assembly 14. By utilizing this arrangement, sufficient strength is provided to allow any winch assembly 14 to be completely severed and not cause the load or batten to fall. Typically, a 14" outside width truss is used to provide sufficient inside clearance to insert an electrical distribution strip 20 for supplying electricity to batten 12, and yet not take up too much space in a rigging system.

Winch assemblies 14 are designed with a very thin profile for allowing battens 12 to be arranged as close as eight inches apart, if necessary. All of the winch assemblies 14 on a single batten 12 are electrically interlocked together by control unit 16. Specifically, winch assemblies 14 on that batten 12 are plugged into electrical distribution strip 20 via a plug 22. Electrical distribution strip 20 has a common control cable system (not shown) contained therein which electrically coupled to control unit 16. A spring loaded cable take-up reel 24 is coupled to the ceiling of the theater or support member 18. Reel 24 has an electrical cable 26 which interconnects electrical distribution strip 20 to control unit 16. A variable speed AC power inverter 204 and computer or microprocessor 202 enables raising and lowering the truss and load smoothly as discussed below. The entire system is user operable and serviceable.

Referring to FIGS. 2–9, each of the winch assemblies 14 includes a support housing 30, a drive unit 32 rigidly coupled to housing 30, a cable drum 34 with a cable 36 spirally wrapped thereabout, a first sheave mounting assembly 38 coupled to support housing 30, a second sheave mounting assembly 40 coupled to either one of the battens 12 or a ceiling support member 18, a drum locking assembly 42 coupled between support housing 30 and cable drum 34, a weight overload/underload protection mechanism 44 coupled to support housing 30, an upper and lower travel limit assembly 46 coupled to housing 30, and a thermal overload switch and motor relay 48 electrically coupled to drive unit 32 and control unit 16.

These unique combination of features in the construction and design of the winch assemblies 14, including its wiring, rigging and control system make it safer, more accessible for service and more cost effective to install than any other system while providing exactly vertical travel. Elevating system 10 with a plurality of winch assemblies 14 can lift up to 50 lbs. of load per ft. of batten length at a rate of about 20 ft. per minute of vertical travel with winch assemblies 14 spaced 10 ft. apart. Although, the lifting power can be increased by adding more winches or increasing the horsepower of the winches.

Figure 6:
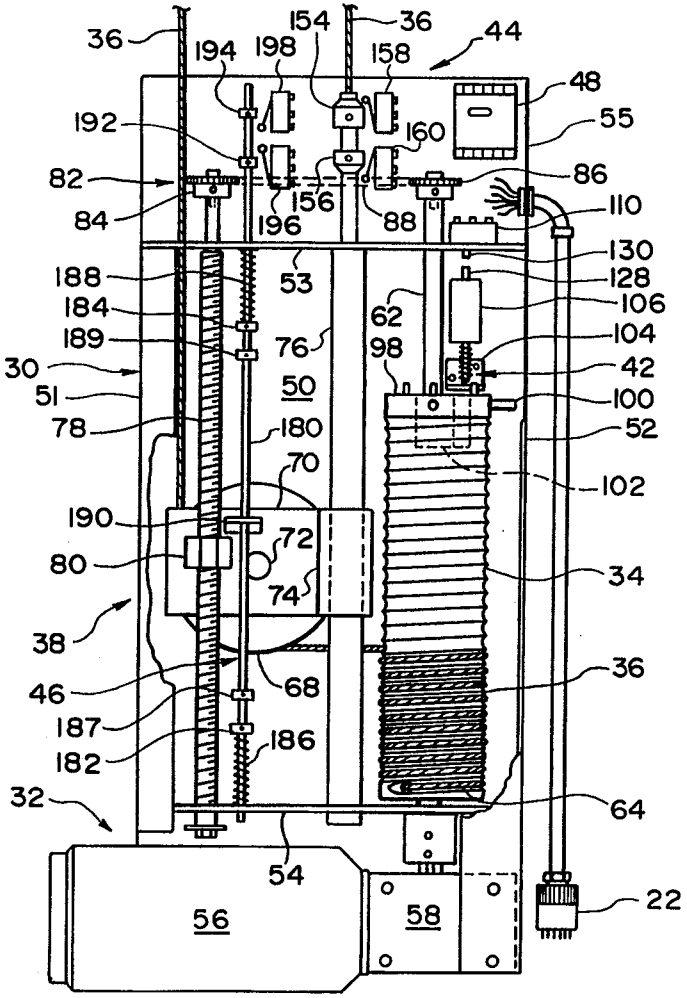
FIG. 6 is a side elevational view of one of the winch assemblies in accordance with the present invention with certain parts removed or broken-away for clarity.

As seen in FIG. 6, support housing 30 is preferably constructed of a rigid sheet metal, and includes a rear wall 50, a pair of side walls 51 and 52, an upper wall 53, a lower wall 54, and an upper support plate 55 rigidly coupled to side walls 51 and 52. Preferably, walls 50–54 are all interconnected to form a rigid housing. A cover (not shown) is removably coupled to side walls 51 and 52 by bolts (not shown) for covering various parts coupled to housing 30.

Drive unit 32 includes a synchronous motor 56 and a locking worm gear speed reducer 58 coupled to the output shaft of motor 56 in a conventional manner. Motors and locking worm gear speed reducers, such as motor 56 and locking worm gear speed reducer 58, are well known in the prior art, and thus they will not be discussed in detail herein.

Synchronous motor 56 is preferably a three-phase 60 Hz, 1800 rpm synchronous motor with one-half horsepower. Synchronous motor 56 is a reversible motor for driving cable drum 34 in both clockwise and counterclockwise directions to raise and lower batten 12. The output shaft of motor 56 is directly coupled to worm gear speed reducer 58 for increasing the torque output of motor 56.

Locking worm gear speed reducer 58 preferably reduces the output speed of motor 56 by about a sixty to one gear ratio. Worm gear speed reducer 58 is directly coupled to cable drum 34 for rotating drum 34 in both the clockwise and counter clockwise directions to raise and lower batten 12.

As seen in FIG. 6, cable drum 34 preferably has a spirally grooved surface for spirally receiving and wrapping cable 36 thereon. Preferably, drum 34 is about $12\frac{1}{2}$ inches long and about $3\frac{7}{8}$ inches to about 4 inches in diameter with five grooves per inch. Drum 34 is rotatably mounted to housing 30 via a drive shaft 62. Specifically, drive shaft 62 is rotatably supported between upper wall 53 and passes through lower wall 54 of housing 30. The lower end of drive shaft 62 is directly coupled to worm gear speed reducer 58, while the upper end of drive shaft 62 is rotatably coupled to first sheave assembly 38 as discussed below.

Cable 36 is preferably 3/16 inch, 7×19 strand aircraft cable. Cable 36 should be rated to provide at least about 8,000 pounds of working load per suspension point. Cable 36 is spirally wrapped around drum 34 so that cable 36 does not overlap upon itself. Cable 36 has a first end 64 fixedly coupled to cable drum 34 and a second end 66 coupled to overload/underload protection mechanism 44. Cable 36 loops about sheave mounting assemblies 38 and 40 to form a cable loop so that each suspension point is supported by two portions of cable 36 between batten 12 and the ceiling of the theater.

First sheave mounting assembly 38 includes a first sheave 68, a sheave mounting carrier 70 rotatably coupled to support sheave 68 via a pin 72, a tubular bearing member 74 fixedly coupled to sheave mounting carrier 70, a guide pipe 76 fixedly coupled to support housing 30 with tubular bearing member 74 slidably coupled thereto, a threaded shaft 78 rotatably coupled to support housing 30, a nut 80 threadedly coupled to threaded shaft 78 and fixedly coupled to sheave mounting carrier 70, and a chain and sprocket assembly 82 for rotating threaded shaft 78 to vertically translate sheave 68 and carrier 70.

Sheave 68 is preferably a conventional eight inch diameter cable sheave or pulley. Accordingly, sheave 68 will not be discussed or illustrated in detail herein. Sheave 68 is rotatably coupled to carrier 70 by pin 72 for receiving and guiding cable 36 from drum 34 to second sheave assembly 40.

Carrier 70 is preferably a rectangular tubular member with sheave 68 positioned therein and rotatably coupled therein via horizontally mounted pin 72. Carrier 70 is vertically movable relative to support housing 30 via tubular bearing member 72 which slidably engages guide pipe 76 and nut 80 which threadedly engages threaded shaft 78.

Tubular bearing member 74 is preferably a vertically oriented, cylindrical tube with a smooth cylindrical bore. Tubular bearing member 74 is welded to carrier 70 and slidably positioned on guide pipe 76.

Guide pipe 76 is fixedly coupled between upper and lower walls 53 and 54 of housing 30, and has a smooth outer surface for slidably engaging the smooth cylindrical bore of tubular bearing member 74. Guide pipe 76 is preferably a hollow tube with a portion of overload/underload protection mechanism 44 as discussed below.

Threaded shaft 78 is preferably a one inch diameter Acme screw with five threads per inch, while nut 80 is preferably an Acme nut with five threads per inch for threadedly engaging threaded shaft 78. Threaded shaft 78 is rotatably coupled to support housing 30 between upper and lower walls 53 and 54 via a pair of bearings (not shown). The upper end of threaded shaft 78 is driven via motor 56. In particular, threaded shaft 78 is rotatably coupled via chain and sprocket assembly 82 to shaft 62 of drum 34, which is coupled to motor 56 via a worm gear speed reducer 58.

Chain and sprocket assembly 82 includes a first sprocket 84 fixedly coupled to the upper end of threaded shaft 78, a second sprocket 86 fixedly coupled to the upper end of drive shaft 62 of cable drum 34, and a chain 88 engaging the teeth of first and second sprockets 84 and 86. Chain 88 is preferably tensioned by an idler sprocket (not shown) in a conventional manner. Accordingly, as motor 56 and worm gear speed reducer 58 rotates drum 34 via shaft 62, it causes threaded shaft 78 to rotate via chain and sprocket assembly 82. As threaded shaft 78 rotates, nut 80 is then translated either up or down threaded shaft 78 depending upon the direction of rotation of threaded shaft 78. Since nut 80 is fixed to sheave carrier 70, sheave 68 and carrier 70 will translate upwardly or downwardly with nut 80 as threaded shaft 78 is rotated in either the clockwise or counterclockwise direction. Carrier 70 is prevented from rotating since it is slidably coupled to housing 30 at two horizontal points via tubular bearing member 72 and guide pipe 76. Accordingly, as carrier 70 translates upwardly and downwardly via threaded shaft 78 and nut 80, tubular bearing member 72 slides vertically along guide pipe 76 to prevent carrier 70 from rotating about threaded shaft 78.

Since cable 36 is wrapped about cable drum five times per inch and nut 80 has five threads per inch, carrier 70 is translated upwardly or downwardly to guide cable 36 smoothly off of cable drum 34. In particular, the portion of cable 36 between drum 34 and sheave 68 is always maintained substantially horizontally during the entire dispensing or retracting of cable 36. In other words, sheave 68 moves vertically upwardly and downwardly at the same rate as cable 36 is wrapped about or unwrapped from drum 34.

As seen in FIGS. 1–5, second sheave mounting assembly 40 includes a sheave 90, a mounting member 92 rotatably supporting sheave 90 via a horizontally mounted pin 94, and a clamp or coupling member 96 for fixedly coupling second sheave mounting assembly 40 either to a batten 12 or ceiling support member 18.

Sheave 90 is preferably a conventional eight inch diameter pulley which receives and engages cable 36 so that sheave 68 and sheave 90 form a cable loop therebetween. Since sheaves, such as sheave 90, are well known in the art, sheave 90 will not be discussed in detail herein.

Mounting member 92 and coupling member 96 are preferably conventional equipment, and thus will not be discussed or illustrated in detail herein.

Figure 9A:
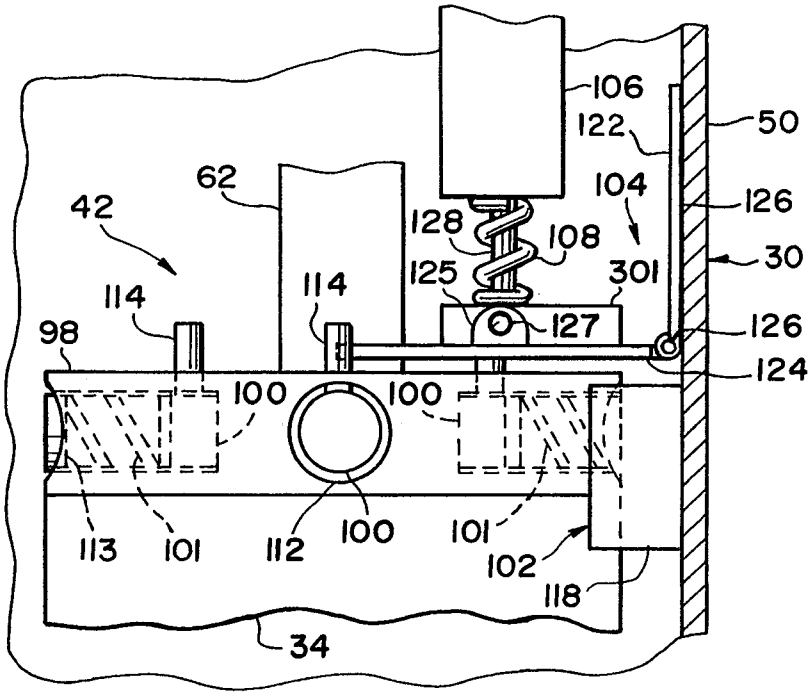
FIG. 9A is an enlarged, partial, end elevational view of the locking assembly of the winch assembly illustrated in FIG. 8.
Figure 8:
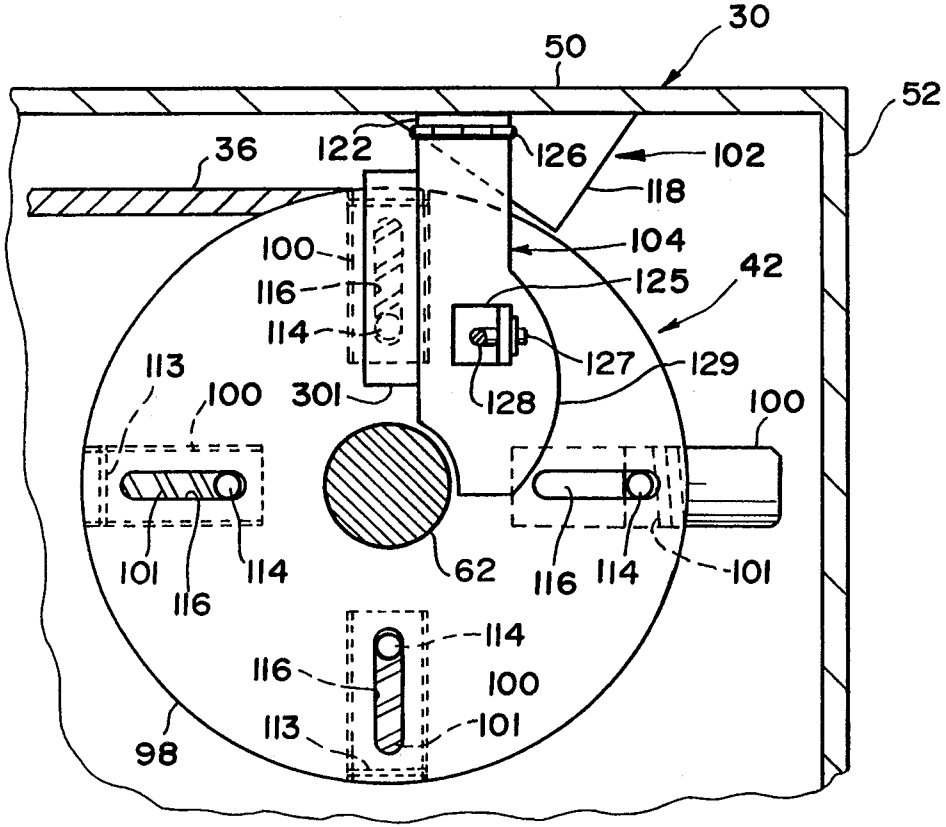
FIG. 8 is an enlarged, partial, top plan view of the locking assembly illustrated in FIG. 6.
Figure 9C:
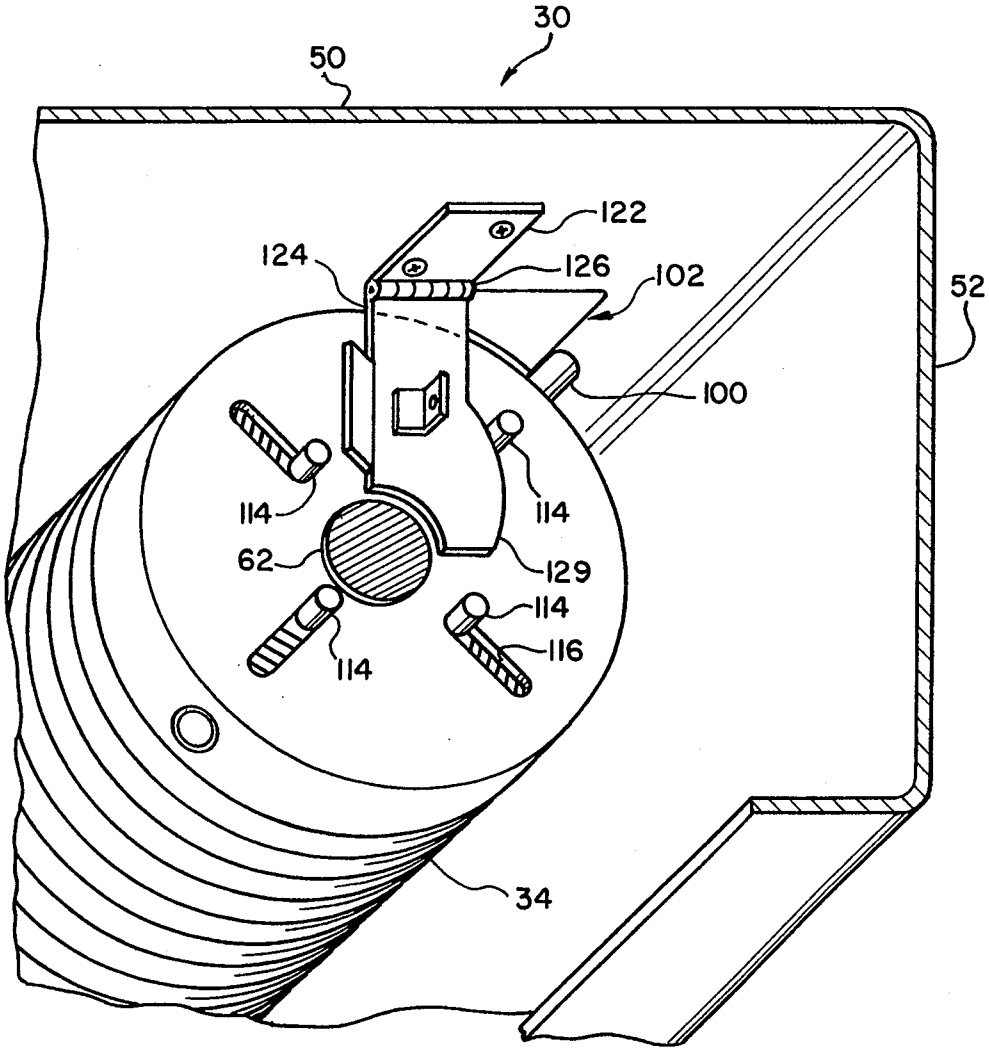
FIG. 9C is an enlarged, partial perspective view of a portion of the locking assembly of FIGS. 9A and 9B with certain parts removed for clarity.
Figure 9B:
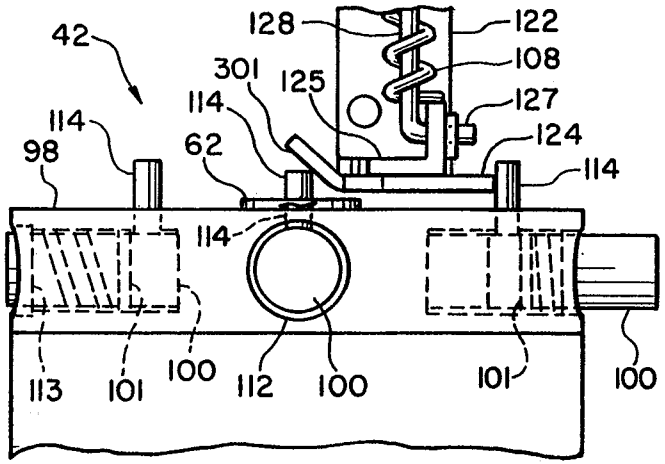
FIG. 9B is an enlarged, partial, front elevational view of the locking assembly of the winch assembly illustrated in FIG. 9A with certain parts removed for clarity.

Referring now to FIGS. 8 and 9, drum locking assembly 42 is located on the end of the cable drum 34 and is activated by the motion of the cable drum 34 unwinding after power is removed from motor 56. However, cable drum 34 will typically be held in its stopped position by worm gear speed reducer 58. Free wheeling situation of cable drum 34 is only possible if an overload occurs or if of the worm gear speed reducers 58 fails.

Drum locking assembly 42 includes a stop bar housing 98 fixedly coupled to the upper end of drum 34, four spring retracted stop bars 100 slidably coupled to stop bar housing 98, four retraction springs 101 coupled to stop bars 100 for biasing stop bars 100 radially inwardly within stop bar housing 98, a stop and reset block 102 fixedly coupled to rear wall 50 of housing 30, a stop cam 104 movably coupled to rear wall 50 of housing 30 for selectively engaging stop bars 100, an electric solenoid 106 fixedly coupled to rear wall 50 of housing 30 and pivotally coupled to stop cam 104 for moving stop cam 104, a compression spring 108 positioned between solenoid 106 and stop cam 104 for biasing stop cam 104 against stop bar housing 98 as described in more detail below, and a solenoid actuator sensing limit switch 110.

Stop bar housing 98 is fixedly coupled to the upper end of drum 34 for rotation therewith, and includes four radially extending bores 112 with retaining rings 113. One of the stop bars 100 is slidably coupled within one of the bores 112 for extending radially outwardly from the center of drum 34. Preferably, stop bars 100 and bores 112 are spaced 90° apart so that drum 34 can be locked within 90° of rotation.

Each stop bar 100 has a vertically extending protruding member or post 114 extending through a slot 116 in the upper surface of stop bar housing 98. Posts 114 limit the inward and outward movements of stop bars 100 within bores 112. Also, each post 114 selectively engages stop cam 104 to move its respective stop bar 100 radially outwardly for engaging stop and reset block 102.

Stop and reset block 102 is preferably a triangular block made of a hard material such as steel, and is fixedly coupled to rear wall 50 of housing 30. Stop and reset block 102 has a stop surface 118 for engaging one of the stop bars 100 to prevent counter clockwise rotation of drum 34, and a reset surface 120 for engaging and forcibly retracting the extended stop bar 100 if the compressed retraction spring 101 failed to fully retract an extended stop bar 100. Stop surface 118 and reset surface 120 preferably form about a 90° angle therebetween. In particular, stop surface 118 extends substantially radially towards the center of drum 34, while reset surface 120 extends substantially tangentially to the surface of drum 34. Thus, reset surface 120 acts as a ramp for gradually engaging and pushing stop bars 100 radially inwardly within bores 112 when drum 34 rotates in the clockwise direction, i.e., when batten 12 is being raised, as seen in FIG. 9. Stop surface 118, on the other hand, will abut the side of one of the stop bars 100 to prevent counterclockwise rotation of drum 34 when one of the stop bars 100 is moved outwardly from bore 112 via edge 129 of stop cam 104.

Stop cam 104 includes a mounting plate 122 fixedly coupled to rear wall 50 of housing 30, and a cam plate 124 hingedly coupled to mounting plate 122 via a horizontal pivot pin 126. Cam plate 124 is positioned adjacent stop bar housing 98 for pivotal movement into and out of the circular path of posts 114. Cam plate 124 has a connector plate 125 fixedly coupled thereto for connecting cam plate 124 to plunger 128. In other words, cam plate 124 can be pivoted downwardly to engage one of the posts 114 of one of the stop bars 100 for sliding stop bar 100 radially outwardly to engage stop surface 118 of stop and reset block 102, when drum 34 is rotated counter-clockwise.

When drum 34 rotates clockwise, mounting plate 122 of stop cam 104 strikes a post 114 with its angled surface 301 which forces cam plate 124 perpendicularly upwardly away from the end of drum 34. Thus, cam plate 124 does not force post 114 to slide radially outwardly from the center of drum 34 during clockwise rotation of drum 34. During counter-clockwise rotation, cam plate 124 is normally biased downwardly into the path of post 114 via compression spring 108. However, solenoid 106 is fixedly connected to cam plate 124 to pivot cam plate 124 upwardly about pivot pin 126 and out of the circular path of post 114 when solenoid 106 is energized, i.e., during clockwise rotation to lower batten 12.

Specifically, solenoid 106 is a conventional electric solenoid with a plunger 128 extending vertically downwardly therefrom. Plunger 128 is bent at its free end to form a horizontal shaft portion 127 which in turn is retained in an opening in connector plate 125 fixedly coupled to cam plate 124 for movement therewith. When solenoid 106 is activated or energized, plunger 128 will retract causing cam plate 124 to pivot upwardly out of the circular path of posts 114. Accordingly, when solenoid 106 is de-energized, spring 108 will move plunger 128 and cam plate 124 downwardly into the circular path of posts 114 for stopping the rotation of drum 34 within 90° of rotation. In particular, edge 129 of cam plate 124 engages one of the posts 114, causing one of the stop bars 100 to be forced radially outwardly from bore 112 of stop housing 98. Thus, the extended stop bar 100 will contact stop surface 118 within a few degrees of rotation to prevent further rotation of drum 34 and prevent further lowering of batten 12.

As seen in FIG. 6, solenoid actuator sensing switch 110 is electrically coupled to control unit 16 and its associated motor 56 to prevent all motors 56 of winch assemblies 14 coupled to a batten from operating unless all switches 110 are actuated by their respective solenoids 106. In other words, if any winch assembly 14 is locked by a deenergized or malfunctioning solenoid 106, then all the other winch assemblies 14 coupled to that particular batten 12 will not operate. In particular, switch 110 is positioned vertically above solenoid 106 so that when solenoid 106 is energized to unlock drum 34, plunger 128 will move vertically upwardly to engage a button 130 on sensing switch 110 to permit motor 56 to operate. The switches 110 of the winch assembly on a single batten are all electrically interconnected at control unit 16 with each other so that none of the motors 56 will operate unless all of the switches 110 are activated by their respective solenoid 106. Thus, all of the cable drums 34 must be unlocked before the batten or truss 12 can be raised or lowered. This ensures that truss or batten 12 remains level.

Figure 7:
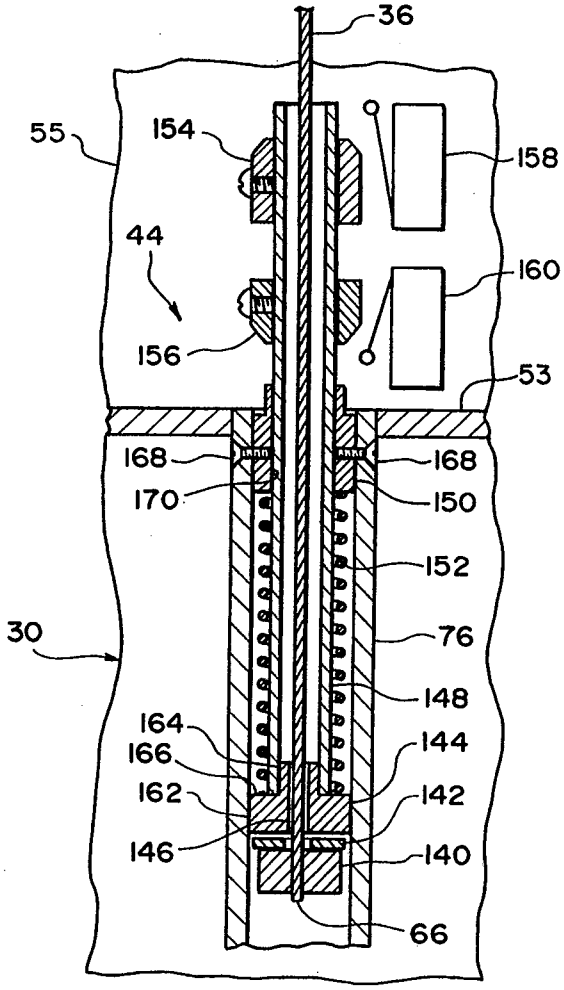
FIG. 7 is an enlarged, partial elevational view of the overload/underload protection assembly of the winch assembly illustrated in FIG. 6.

Referring now to FIG. 7, overload/underload protection mechanism 44 includes the following parts: (1) an end fitting 140 fixedly coupled to second end 66 of cable 36, (2) a washer 142 positioned about second end 66 of cable 36 adjacent to end fitting 140, (3) an Oilite bronze sliding end member 144 with a longitudinal extending bore 146 for receiving second end 66 of cable 36 therethrough, (4) a cable terminating tube 148 positioned about second end 66 of cable 36, (5) a sleeve bearing 150 fixedly coupled to housing 30 via guide pipe 76, (6) a compression spring 152 positioned between end member 144 and sleeve bearing 150, (7) an overload limit switch activating collar 154 fixedly coupled to the upper end of cable terminating tube 148, (8) an underload limit switch activating collar 156 fixedly coupled to cable terminating tube 148 and vertically spaced below overload limit switch activating collar 154, (9) an overload limit switch 158 fixedly coupled to rear wall 50 of housing 30 adjacent overload limit switch activating collar 154, and (10) an underload limit switch 160 fixedly coupled to rear wall 50 of housing 30 adjacent underload limit switch activating collar 156.

End fitting 140 is preferably a Nicopress fitting which is swaged onto the very end of second end 66 of cable 36 for retaining washer 142, end member 144, tube 148 and spring 152 on second end 66 of cable 36.

End member 144 preferably has a first cylindrical portion 162 with a diameter sized to frictionally engage the inner surface of guide pipe 76, a second cylindrical portion 164 with a diameter slightly smaller than the inner diameter of tube 148, and an annular abutment surface 166 extending between cylindrical portions 162 and 164. End member 144 is retained within guide pipe 76 while first cylindrical portion 162 slidably engages the internal surface of guide pipe 76. Cylindrical portions 162 and 164 are integrally formed as a one-piece member. Annular abutment surface 166 engages one end of compression spring 152 and one end of cable terminating tube 148.

Sleeve bearing 150 is preferably an Oilite bronze sleeve bearing which is fixedly coupled within the upper end of guide pipe 76 via set screws 168. Sleeve bearing 150 has a cylindrical bore 170 sized for slidably receiving cable terminating tube 148 therein. Sleeve bearing 150 also engages the upper end of compression spring 152 so that compression spring 152 is maintained slightly compressed between the lower surface of sleeve bearing 150 and abutment surface 166 of end member 144.

Accordingly, compression spring 152 resiliently supports housing 30 on second end 66 of cable 36. In other words, compression spring 152 provides a cushion mounting arrangement between cable 36 and winch housing 30. Compression spring 152 is normally partially compressed due to either the weight of winch assembly 14 and the batten 12 coupled thereto in a self-climbing position, or the weight of second sheave mounting assembly 40 and batten 12 is in the inverted position.

Overload limit switch activating collar 154 and underload limit switch activating collar 156 are substantially identical, except that they are mirror images of each other. Collars 154 and 156 are fixedly and removably coupled to cable terminating tube 148 via set screws 172. Accordingly, collars 154 and 156 can be moved vertically along tube 148 to compensate for changes in weight of the truss or batten 12. In other words, collars 154 and 156 can be adjusted to vary the amount underload or overload weight which can be applied to batten 12 before either limit switches 158 or 160 are engaged by their respective collar.

Overload switch 158 and underload switch 160 are fixedly coupled to housing 30 so as to remain stationary relative to housing 30 and move relative to cable 36 via spring 152. Accordingly, when winch assembly 14 is mounted in the self-climbing position, an overload on batten 12 will cause housing 30 to compress spring 152 moving overload collar 154 into engagement with overload switch 158. If an underload occurs in a self-climbing arrangement, compression spring 152 is relieved of pressure and expands so that underload limit switch 160 moves upwardly to engage collar 156.

In an inverted position, winch assembly 14 is stationary so that when an overload or underload occurs, cable 36 moves and either compresses or expands compression spring 152. Compression of spring 152 by cable 36 cause cable terminating tube 148 and collars 154 and 156 to move downwardly relative to winch housing 30 so that overload collar 154 engages overload limit switch 158. If an underload occurs in the inverted winch assembly arrangement, cable 36 relieves pressure on spring 152 causing tube 148 and underload collar 156 to move upwardly and engage the stationary limit switch 160.

When either an underload or overload occurs, this will result in one or more limit switches 158 or 160 to be actuated in the winch assemblies 14 coupled to that batten. Accordingly, limit switches 158 and 160 are all electrically coupled together so that control unit 16 will shut off all of the winch assemblies on the batten, experiencing the overload or underload, even if only one limit switch is tripped.

Referring now to FIG. 6, upper and lower travel limit assembly 46 includes an end of travel bar 180 slidably coupled between upper and lower walls 53 and 54 of housing 30, a lower end of travel collar 182 fixedly coupled to travel bar 180, an upper end of travel collar 184 fixedly coupled to travel bar 180 and spaced vertically from lower end of travel actuator collar 182, a first compression spring 186 positioned between a lower collar 187 and lower wall 54 for upwardly biasing travel bar 180, a second compression spring 188 positioned between an upper collar 189 and upper wall 53 for downwardly biasing travel bar 180, an actuator plate 190 fixedly coupled to carrier 70 and slidably coupled to travel bar 180, an upper end actuator 192 fixedly coupled to the upper end of travel bar 180, a lower end actuator 194 fixedly coupled to the upper end of travel bar 180, an upper end of travel limit switch 196 fixedly coupled to support plate 155, and a lower end of travel limit switch 198 fixedly coupled to support plate 155.

Accordingly, travel bar 180 is normally held in a stationary position by springs 186 and 188 acting on collars 187 and 189, respectively. In other words, collars 187 and 189 hold springs 186 and 188 in a set spring tension to keep the travel bar 180 in a centrally located position. However, when winch assembly 14 is fully lowered, carrier 70 of sheave mounting assembly 38 will move vertically downwardly so that actuator plate 190 engages lower end collar 182 which compresses spring 186 causing travel bar 180 to slide downwardly relative to housing 30. This downward movement of travel bar 180 causes lower end actuator 194 to engage lower limit switch 198 to stop motor 56. Likewise, when winch assembly 14 is fully raised, carrier 70 of mounting sheave assembly 38 will move vertically upwardly, causing actuator plate 190 to engage upper end collar 184 to compress spring 188 and move travel bar 180 upwardly relative to housing 30. This upward movement of travel bar 180 will cause upper end actuator 192 to engage upper limit switch 196 to stop motor 56.

The lower travel limit switches 198 of each winch assembly 14 coupled to a single batten 14 cooperate together to relevel batten 12 upon completely lowering batten 12. Specifically, as batten 12 is lowered, each of the winch assemblies 14 coupled to batten 12 will stop at their lowermost position independently of the other winch assemblies 14 coupled thereto. Thus, if batten 12 is unlevel, any winch assembly 14 which is out of sync or unlevel with the other winch assemblies will continue to operate and lower until its lower limit switch 198 cuts its motor off. In other words, each of the motors 56 of each of the winch assemblies 14 are independently stopped so that each winch assembly can move to its lowermost position wherein all of the winch assemblies on a single batten were previously set.

Thermal overload switch and motor relay 48 is a conventional thermal overload switch and motor relay with a built in reset using a conventional electrical circuit which is electrically coupled to motor 56. Since overload thermal switches, such as thermal overload switch and motor relay 48, are conventional and well known, thermal overload switch and motor relay 48 will not be discussed or illustrated in detail herein.

Figure 10:
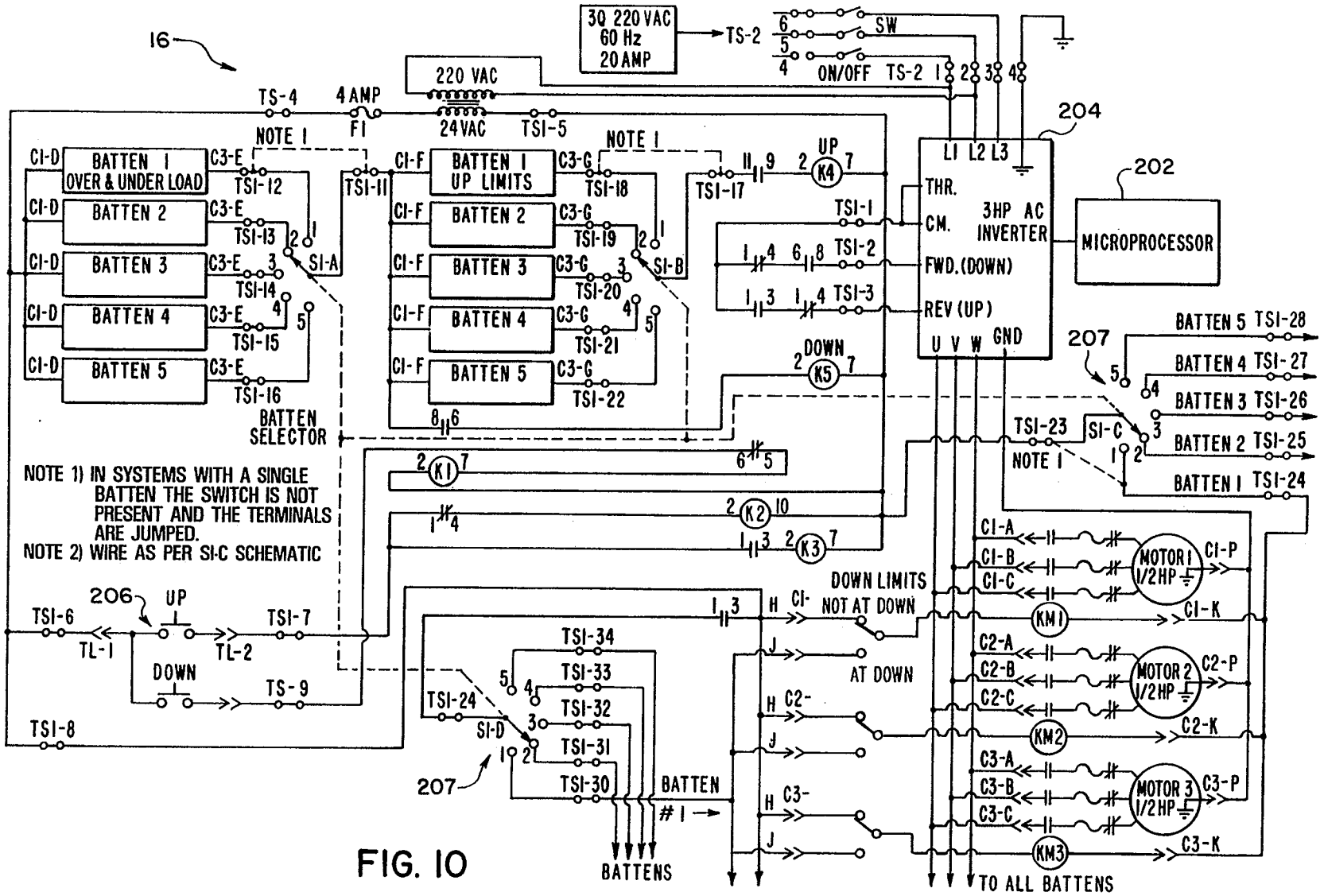
FIG. 10 is a partial circuit schematic of the elevating system illustrated in FIGS. 1–9 for operating five battens with three winch assemblies per batten.
Figure 11:
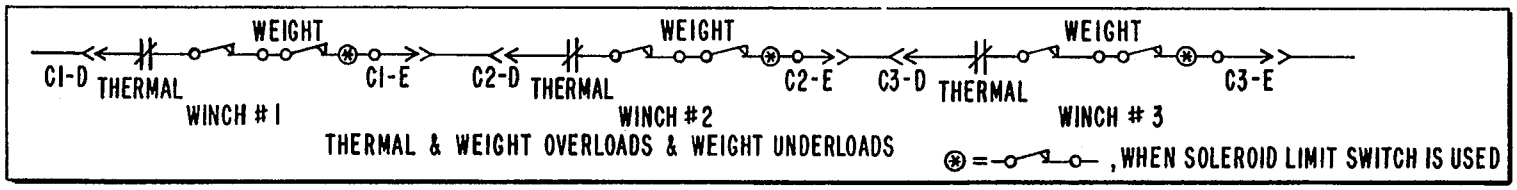
FIG. 11 is an enlarged, partial circuit schematic of one of the thermal protection switches and the overload/underload protection switches for controlling the three winch assemblies coupled to one of the battens.
Figure 12:
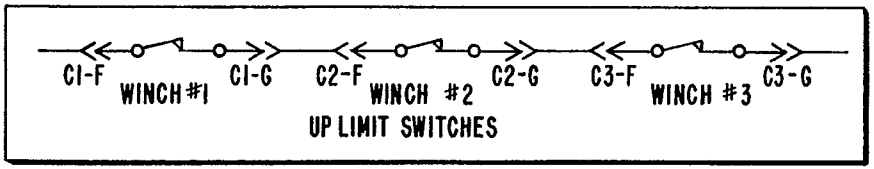
FIG. 12 is an enlarged, partial circuit schematic of one of the up limit switches for controlling the three winch assemblies coupled to one of the battens.
Figure 14:
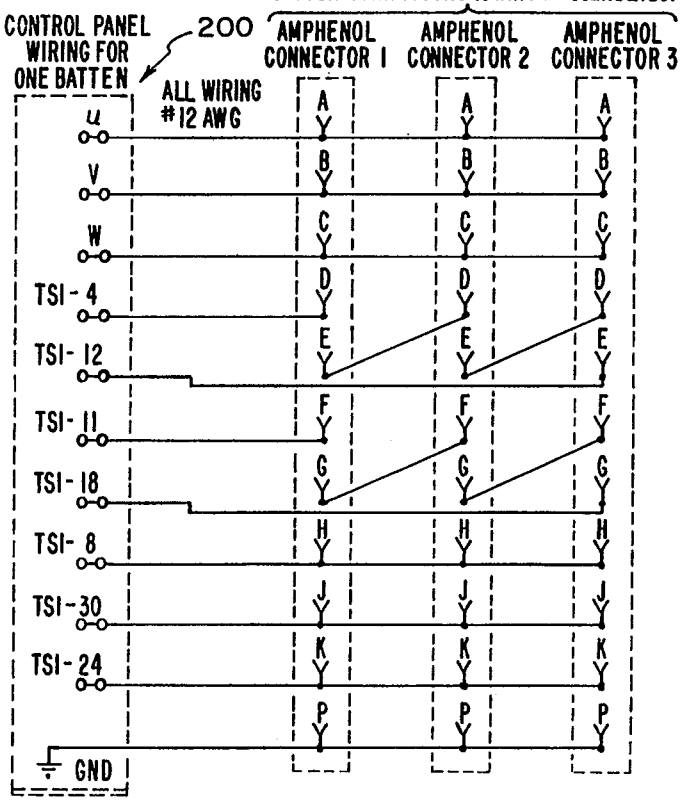
FIG. 14 is a partial circuit schematic of the wiring interconnecting the control unit with the three winch assemblies of a single batten.
Figure 13:
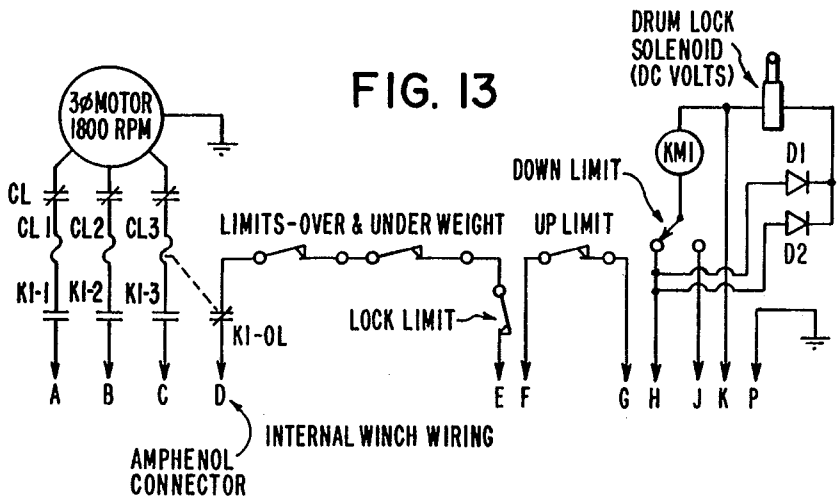
FIG. 13 is a partial circuit schematic of the internal wiring for one of the winch assemblies.

As seen in FIG. 10, control unit 16 includes a control panel 200, a microprocessor 202 mounted in control panel 200, an AC inverter 204 mounted in control panel 200, and a hand pendant control 206 electrically coupled to microprocessor 202 and AC inverter 204.

Control units, as well as control panels, microprocessors, AC inverters and hand pendant controls are all well known and conventional equipment, which can be adapted by those skilled in the art once given this disclosure to operate elevating system 10. Accordingly, the details of control unit 16, control panel 200, microprocessor 202, AC inverter 204 and pendant control 206 will not be discussed or illustrated in detail herein.

The winch assemblies 14 with synchronized motors 56 are all controlled by the single programmable variable frequency AC inverter 204. Accordingly, AC inverter 204 should have sufficient capacity to operate the largest number of motors 56 of the group of winch assemblies 14 in any truss or batten 12 in the installation. The single programmable AC inverter 204 with microprocessor 202 provides smooth, soft, ramped starting and stopping as well as torque boost and electric braking.

Dangerous instant reversal of elevating system 10 is not possible by the operator as the AC inverter 204 always initiates a programmed ramped slow down and stop of the winch assemblies 14. By using a selector switch 207 on control panel 200 the single AC inverter 204 can be used to drive, and controls any group of winch assemblies 14 on any single batten 12 on the stage. This spreads the cost of a single electronic control unit over all of the winch assemblies used in the entire rigging system of the installation.

Each individual winch assembly 14 is interlocked with all of the other winch assemblies 14 on the particular truss or batten 12 by control panel 200. Any single failure in any winch assembly 14 on that batten stops all other winch assemblies on that batten automatically. In particular, as seen in the circuit schematics of FIGS. 10–14, all of the drive units 32, the drum locking assemblies 42, the weight overload/underload protection mechanisms 44, the travel limit assemblies 46, and the thermal overload switches 48 are all interconnected with control unit 16, as shown in FIG. 1.

Again as shown in FIG. 1, a long remote control cord 208 (typically 25 to 50 ft.) electrically couples hand pendant control 206 to control panel 200. Thus, a single operator can visually monitor the operation of batten 12 for obstructions at all points of the load during the entire travel of the load. By reprogramming the AC inverter 204 to a higher output frequency the raising and lowering speed of elevating system 10 can be increased but at the expense of lifting power.

AC inverter 204 operates heavy duty synchronous motors 56 at less than 80% of their rating to slowly ramp the motor speed up and down by varying the input frequency in conjunction with the weight limiting action of the weight limiting switches 158 and 160. Thus, the entire elevating system 10 remains in perfect level at all times as the motors 56 are locked exactly to the input AC frequency from AC inverter 204.

Any out of level during installation, is automatically eliminated by system releveling itself during full down travel where the lower end of travel limit switches 198 individually shut down each drive motor 58. Up travel is automatically limited by any motor hitting its upper limit switch 196 thereby shutting down the AC inverter 204 to a ramped speed slowdown and finally stopping all drive motors 56 simultaneously.

Each batten 12 uses four unique wires with seven other wires wired in parallel to the single control unit 12. Standard, inexpensive #12 AWG wiring can be used in all installations using six or less individual ½ HP winch assemblies 14 in a single batten 12.

Referring now to the schematics circuit of FIGS. 10–14, three phase 208/230 volt 60 Hz power is supplied to the AC inverter and the primary of the step down control voltage transformer at terminals TS-2 1 thru 4. The output of control voltage transformer is twenty four volts AC and is fused by F1 at 4 amps. The twenty four volt control voltage is provided at terminal TS1-4, TS1-6 and TS1-8. TS1-4 connects to connector pin C1-D on every motorized truss and to one side of the control switch contacts for the up and down push button thru TS1-6 and twistlock connector TL. When the down pushbutton is closed, the twenty four volt control voltage is also connected from TS1-4 thru TS1-8 through every connector pin H of every winch on every batten to the not at up contact of every down limit switch in every winch assembly 14. Any winch assembly 14 not at its fully down position will pass the control voltage thru the normally closed contacts in its down limit switch to the motor contactor coil of relay KM in each winch assembly. Selector switch S1-C selects the return side of all KM relay coils on a selected batten thereby completing the circuit back to TS1-5 of the control transformer and energizing all motor starter coils in the selected circuit. KM relay contacts connect the three phase variable frequency output of the AC inverter 204 to the selected winch motors 56. The control voltage passes thru the thermal overload contacts, weight overload limit switch, and weight underload limit switch and when included, the solenoid lock limit switch of every winch assembly 14 on every batten 12 and terminates at contacts 1 thru 5 of selector switch S1-A. Switch S1 selects which batten and associated group of winch overload switches is selected. Three winch motors 56 are illustrated, however additional may be added on any batten provided the total current requirements do not exceed the supplied power and the ability of the AC inverter 204 to control and deliver the necessary current.

Once thru the overload limits, the 24 volt signal can be directed either thru the up end of travel limits of all of the winches on any selected batten (as selected by S1-B) or to the normally open contacts K1-8&6.

To energize the AC inverter 204 in the down direction, the Down pushbutton, thru the normally closed contacts of K2-6&5, energizes relay K1 closing its normally open contacts 8&6. This allows the control voltage that has successfully passed thru all of the selected battens' thermal and weight limits and lock limits, to energize relay K5. Relay K5, thru its normally open contacts 6&8 and thru relay K4's normally closed contacts 1&4 connect the CM terminal and the FWD terminal of the AC inverter 204. This initializes the preprogrammed start ramp up frequency of the AC inverter 204 and generates the controlled voltage and frequency signal to the selected winch motors 56 thru terminals U, V & W.

As each winch assemblies 14 reaches its full down position, its down limit switch 160 is tripped transferring the individual winch motor's starter contactor coil to the J contacts of each motors winch connector. The coil is deenergized and the motor 56 stops quickly in its extreme down position. The "J" set of connector pins are only energized by the control voltage during the up pushbutton activation and only if the down pushbutton has not already been depressed and it S1-D button selection switch has selected the batten. This is because relay contacts K1-1&4 would be open not allowing the up control voltage to energize relay K3 which connects the selected up control voltage to pins J of all winch connectors thru its normally open contacts 1&3.

Closing the up pushbutton contacts also energized relay K2 closing contacts K2-11&9. This enables the control voltage that has been selected by S1-A, passed thru all of the normally closed "up end of travel" limit switches in all of the winch assemblies 14 on the batten 12 selected by S1-B, to energize relay K4. Relay K4 when energized, connects the AC inverter control terminals CM and REV thru contacts K4-1&3 and normally closed contacts K5-1&4. This initiates the AC inverter 204 to ramp up in frequency as preprogrammed in the opposite direction. If the AC inverter 204 control inputs are instantly reversed, the program will ramp down in frequency at the preprogrammed slow rate to a momentary stop and then reverse output and ramp up in the opposite direction.

If during operation, any selected motor 56 draws excessive current for any reason, the thermal overloads set and selected for the motor size, will open the overload circuit for the entire batten and disconnect control voltage for both the up and down AC inverter control relays K4 and K5. The AC inverter 204 will ramp its output down and shut down until the overload relay resets itself. They automatically reset upon cool down of the internal heating element. Any weight overload or weight underload on any winch will act exactly the same except the weight must be corrected before the batten can be energized again.

While only one embodiment has been chosen to illustrate the invention, it will be understood by those skilled in the art that various changes and modifications can be made herein without departing from the scope of the invention as defined in the appended claims.

What is claimed is:

1. An elevating system for raising and lowering items, comprising:

first support means for supporting an item to be raised and lowered;

at least two winch means, coupled to said support means at spaced locations, for raising and lowering said support means, each of said winch means including a cable, a winch housing, rotatably mounted drum means, coupled to said winch housing, for dispensing and retracting said cable therefrom, and synchronous motor means for rotating said drum means; and control means, electrically coupled to each of said motor means, for operating each of said winch means, said control means including single inverter means, electrically coupling each of said motor means in parallel, for starting and stopping said motor means by varying input frequency to slowly ramp the output of said motor means during starting and stopping of said motor means.

2. An elevating system according to claim 1, wherein each of said winch means further includes first sheave means operatively engaging said cable to form a cable loop relative to said drum means.

3. An elevating system according to claim 1, wherein each of said winch means includes weight overload means for stopping said motor means upon detecting a weight overload on said cable.

4. An elevating system according to claim 3, wherein each of said winch means includes weight underload means for stopping said motor means upon detecting a weight underload on said cable.

5. An elevating system according to claim 1, wherein each of said winch means includes weight overload-/underload protection means, coupled to said second end of said cable, for sensing weight overloads and weight underloads on said cable to stop said motor means, said weight overload/underload protection means includes biasing means coupled between said second end of said cable and said mounting member, and switch means, electrically coupled to said motor means, for stopping rotation of said drum means upon a predetermined distance of deflection of said biasing means.

6. An elevating system according to claim 5, wherein said biasing means includes an end member fixedly coupled to said second end of said cable and a compression spring abutting against said end member and said mounting member.

7. An elevating system according to claim 6, wherein said mounting member includes a sleeve fixedly coupled to said winch housing for receiving said cable therethrough.

8. An elevating system according to claim 7, wherein said switch means is fixedly coupled to said winch housing.

9. An elevating system according to claim 8, wherein said biasing means further includes a tubular member concentrically arranged relative to said compression spring and fixedly coupled to said end member for movement therewith, and a first actuating member coupled to said tubular member for movement therewith, and positioned for engaging said switch means.

10. An elevating system according to claim 9, wherein said biasing means further includes a second actuating member coupled to said tubular member for movement therewith, and positioned for engaging said switch means.

11. An elevating system according to claim 10, wherein said switch means includes a weight overload limit switch fixedly coupled to said winch housing adjacent said first actuating member, and a weight underload limit switch fixedly coupled to said winch housing adjacent said second actuating member.

12. An elevating system according to claim 11, wherein said weight overload limit switch is vertically spaced from said weight underload limit switch.

13. An elevating system according to claim 1, wherein each of said winch assemblies includes thermal overload means for stopping said motor means upon sensing a thermal overload.

14. An elevating system according to claim 1, wherein each of said winch means further includes drum locking means, coupled to said drum means and said winch housing, for preventing rotation of said drum means upon stopping said motor means, said drum locking means includes first stop means coupled to said drum means, second stop means coupled to said winch housing, and activating means for moving one of said first and second stop means so that said first stop means engages said second stop means to prevent a full rotation of said drum means.

15. An elevating system according to claim 14, wherein said first stop means is slidably coupled to said drum means.

16. An elevating system according to claim 15, wherein said activating means includes cam means movably mounted to said winch housing, and said first stop means includes at least one protruding member which selectively engages said cam means for moving said first stop means radially outwardly from said drum means.

17. An elevating system according to claim 16, wherein said activating means includes a solenoid with a plunger fixedly coupled to said cam means for moving said cam means into and out of engagement with said first stop means.

18. An elevating system according to claim 17, wherein said first stop means includes a plurality of stop bars with each of said stop bars having one of said protruding members coupled thereto.

19. An elevating system according to claim 18, wherein said second stop means is a triangular block with a stop surface extending towards the center of said drum means, and a reset surface extending substantially tangentially to the outer periphery of said drum means.

20. An elevating system according to claim 19, wherein each of said stop bars includes a spring for inwardly biasing each of said stop bars to a retracted position.

21. An elevating system according to claim 1, wherein said control means further includes releveling means, coupled to each of said motor means, for individually and independently stopping each of said motor means after each of said winch means reaches a predetermined lowermost position.

22. An elevating system according to claim 21, wherein said releveling means includes a lower travel limit switch coupled to each of said motor means.

23. An elevating system according to claim 22, wherein said releveling means further includes a sheave mounting assembly coupled to each of said winch means for engaging said cable of its respective said winch means, each of said sheave mounting assemblies includes a sheave rotatably mounted on a carrier member, and translating means for moving said carrier member and said sheave vertically as said drum means rotates to raising and lowering said first support means.

24. An elevating system according to claim 23, wherein each of said translating means includes a vertically mounted threaded shaft fixedly coupled to said winch housing, and a threaded nut fixedly coupled to said carrier member and threadedly coupled on said threaded shaft.

25. An elevating system according to claim 24, wherein each of said sheave mounting assemblies include a vertically mounted travel bar slidably coupled to said winch housing, a pair of springs engaging said travel bar to normally maintain said travel bar in a predetermined position, and an actuator fixedly coupled to said carrier member and positioned adjacent said travel bar for engaging and moving said travel bar into engagement with said lower travel limit switch when said winch means reaches its lowermost position.

26. An elevating system according to claim 25, wherein said control means further includes an upper travel limit switch fixedly coupled to said winch housing adjacent said travel bar so that said travel bar engages said upper travel limit switch when said winch means reaches a predetermined uppermost position.

27. An elevating system for hoisting items, the combination comprising:

first support means for supporting an item to be raised and lowered;

at least two winch means, coupled to said support means at spaced locations, for raising and lowering said support means, each of said winch means including a cable, a winch housing, rotatably mounted drum means, coupled to said winch housing, for dispensing and retracting said cable therefrom, and synchronous motor means for rotating said drum means; and control means, electrically coupled to each of said motor means, for operating each of said winch means, said control means including releveling means, coupled to each of said motor means, for individually and independently stopping each of said motor means after each of said winch means reaches a predetermined lower most position.

28. An elevating system according to claim 27, wherein said releveling means includes a lower travel limit switch coupled to each of said motor means.

29. An elevating system according to claim 28, wherein said releveling means further includes a sheave mounting assembly coupled to each of said winch means for engaging said cable of its respective said winch means, each of said sheave mounting assemblies includes a sheave rotatably mounted on a carrier member, and translating means for moving said carrier member and said sheave vertically as said drum means rotates to raising and lowering said first support means.

30. An elevating system according to claim 29, wherein each of said translating means includes a vertically mounted threaded shaft fixedly coupled to said winch housing, and a threaded nut fixedly coupled to said carrier member and threadedly coupled on said threaded shaft.

31. An elevating system according to claim 30, wherein each of said sheave mounting assemblies include a vertically mounted travel bar slidably coupled to said winch housing, a pair of springs engaging said travel bar to normally maintain said travel bar in a predetermined position, and an actuator fixedly coupled to said carrier member and positioned adjacent said travel bar for engaging and moving said travel bar into engagement with said lower travel limit switch when said winch means reaches its lowermost position.

32. An elevating system according to claim 31, wherein said control means further includes an upper travel limit switch fixedly coupled to said winch housing adjacent said travel bar so that said travel bar engages said upper travel limit switch when said winch means reaches a predetermined uppermost position.

33. A winch assembly for hoisting items, the combination comprising:

a winch housing adapted to be coupled to a first support member;

drum means, rotatably coupled to said winch housing, for dispensing and retracting a cable therefrom, said cable having a first end fixedly coupled to said drum means and a second end coupled to a mounting member;

motor means, coupled to said drum means, for rotating said drum means;

a first sheave adapted to be rotatably mounted to a second support member spaced from the first support member for operatively engaging said cable;

weight overload/underload protection means, coupled to said second end of said cable, for sensing weight overloads and weight underloads on said cable to stop said motor means, said weight overload/underload protection means including biasing means coupled between said second end of said cable and said mounting member, and switch means, electrically coupled to said motor means, for stopping rotation of said drum means upon a predetermined distance of deflection of said biasing means.

34. A winch assembly according to claim 33, wherein said biasing means includes an end member fixedly coupled to said second end of said cable and a compression spring abutting against said end member and said mounting member.

35. A winch assembly according to claim 34, wherein said mounting member includes a sleeve fixedly coupled to said winch housing for receiving said cable therethrough.

36. A winch assembly according to claim 35, wherein said switch means is fixedly coupled to said winch housing.

37. A winch assembly according to claim 36, wherein said biasing means further includes a tubular member concentrically arranged relative to said compression spring and fixedly coupled to said end member for movement therewith, and a first actuating member coupled to said tubular member for movement therewith, and positioned for engaging said switch means.

38. A winch assembly according to claim 37, wherein said biasing means further includes a second actuating member coupled to said tubular member for movement therewith, and positioned for engaging said switch means.

39. A winch assembly according to claim 38, wherein said switch means includes a weight overload limit switch fixedly coupled to said winch housing adjacent said first actuating member, and a weight underload limit switch fixedly coupled to said winch housing adjacent said second actuating member.

40. A winch assembly according to claim 39, wherein said weight overload limit switch is vertically spaced from said weight underload limit switch.

41. A winch assembly for hoisting items, the combination comprising:

a winch housing adapted to be coupled to a first support member;

drum means, rotatably coupled to said winch housing, for dispensing and retracting a cable therefrom, said cable having a first end fixedly coupled to said drum means and a second end coupled to a mounting member;

motor means, coupled to said drum means, for rotating said drum means; and drum locking means, coupled to said drum means and said winch housing, for preventing rotation of said drum means upon stopping said motor means, said drum locking means including first stop means coupled to said drum means, second stop means coupled to said winch housing, and activating means for moving one of said first and second stop means so that said first stop means engages said second stop means to prevent a full rotation of said drum means.

42. A winch assembly according to claim 41, wherein said first stop means is slidably coupled to said drum means.

43. A winch assembly according to claim 42, wherein said activating means includes cam means movably mounted to said winch housing, and said first stop means includes at least one protruding member which selectively engages said cam means for moving said first stop means radially outwardly from said drum means.

44. A winch assembly according to claim 43, wherein said activating means includes a solenoid with a plunger fixedly coupled to said cam means for moving said cam means into and out of engagement with said first stop means.

45. A winch assembly according to claim 44, wherein said first stop means includes a plurality of stop bars with each of said stop bars having one of said protruding members coupled thereto.

46. A winch assembly according to claim 45, wherein said second stop means is a triangular block with a stop surface extending towards the center of said drum means, and a reset surface extending substantially tangentially to the outer periphery of said drum means.

47. An elevating system for raising and lowering items, comprising:

first support means for supporting an item to be raised and lowered;

at least one winch means, coupled to said support means, for raising and lowering said support means, said winch means including a cable, a winch housing, rotatably mounted drum means, coupled to said winch housing, for dispensing and retracting said cable therefrom, and synchronous motor means for rotating said drum means; and control means, electrically coupled to said motor means, for operating said winch means, said control means including single inverter means, electrically coupled to said motor means, for starting and stopping said motor means by varying input frequency to slowly ramp the output of said motor means during starting and stopping of said motor means, and for increasing the normal operating speed of said motor means.

* * * * *